United States Patent [19]

Kristofek

[11] 4,250,540

[45] Feb. 10, 1981

[54] MOUNTING ARRANGEMENT FOR RECESSED LIGHT FIXTURE HOUSING

[75] Inventor: Paul J. Kristofek, Hickory Hills, Ill.

[73] Assignee: McGraw-Edison Co., Rolling Meadows, Ill.

[21] Appl. No.: 68,933

[22] Filed: Aug. 23, 1979

[51] Int. Cl.[3] ..... F21S 1/02; F21S 3/02

[52] U.S. Cl. ..... 362/368; 362/404

[58] Field of Search ..... 362/368; 362/404

[56] References Cited

U.S. PATENT DOCUMENTS

| | | | |
|---|---|---|---|
| 3,018,083 | 1/1962 | Berger . | |
| 3,381,126 | 4/1968 | Steiner | 362/368 |
| 4,175,281 | 11/1969 | Lonseth | 362/368 |

FOREIGN PATENT DOCUMENTS

| | | | |
|---|---|---|---|
| 2505562 | 8/1967 | Fed. Rep. of Germany | 362/406 |
| 2617722 | 3/1977 | Fed. Rep. of Germany | 362/406 |

*Primary Examiner*—Benjamin R. Padgett
*Assistant Examiner*—Irwin Gluck
*Attorney, Agent, or Firm*—Ronald J. LaPorte; Jon Carl Gealow; Roy A. Ekstrand

[57] ABSTRACT

An arrangement for mounting an enclosed light fixture housing having an open end with a flange formed about the periphery thereof, in recessed fashion in an aperture defined in a planar support member having inner and outer surfaces, with the flange of the housing engaging the outer surface, includes a side wall of the housing defining a T-shaped slotted aperture with the longer leg of the T extending from the shorter leg toward the open end of the housing, and having ratchet teeth formed along an edge of the longer leg of the T, and a mounting clip receivable in the slotted aperture from the interior of the housing after the housing is received in the aperture in the support member. The mounting clip is captured in the slotted aperture and slidable toward and away from the inner surface of the support member. A first tab of the mounting clip is engagable with the last-mentioned surface of the support member and a second tab of the mounting clip engages the ratchet teeth to lock the first tab in place, thereby releasably securing the housing on the support member.

7 Claims, 7 Drawing Figures

FIG. 1
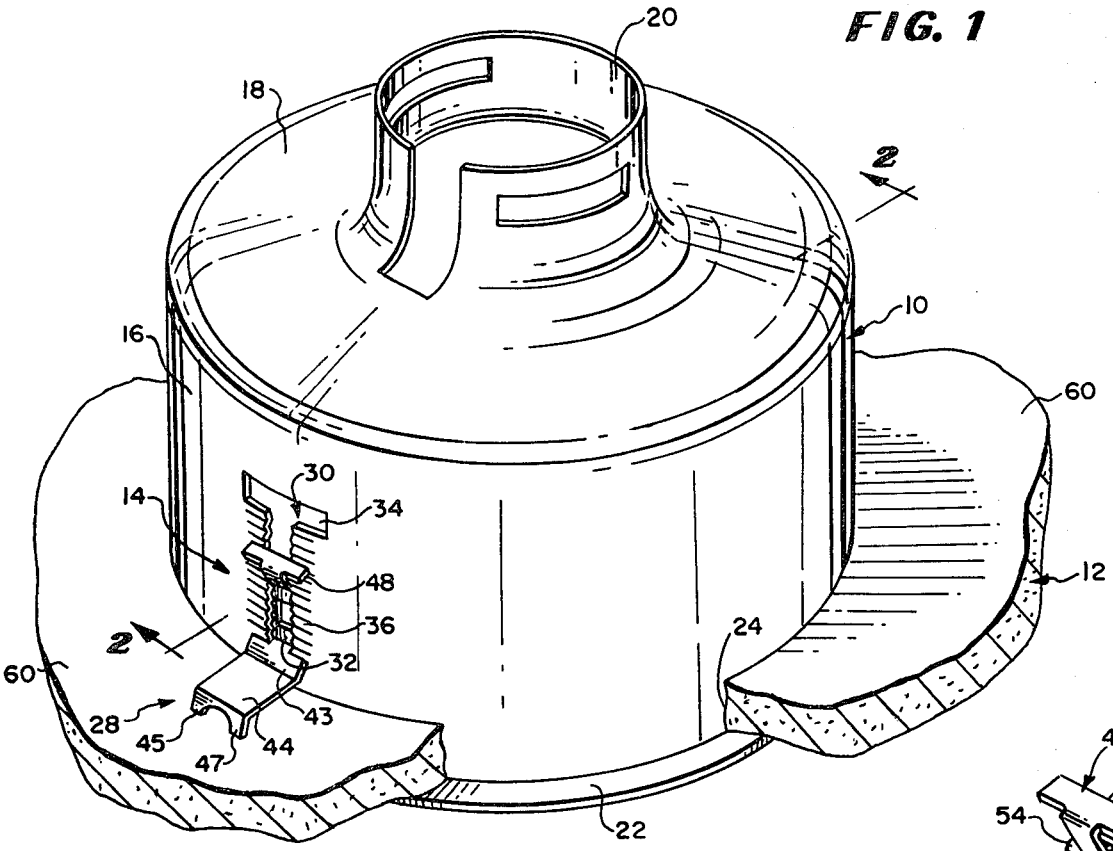
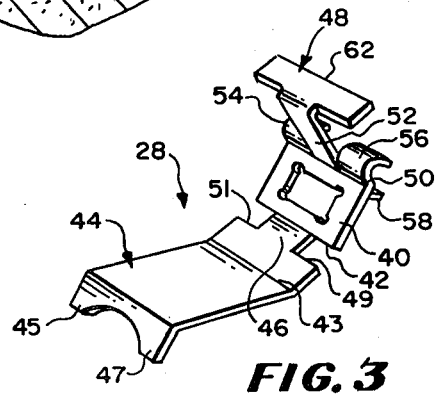
FIG. 3
FIG. 2
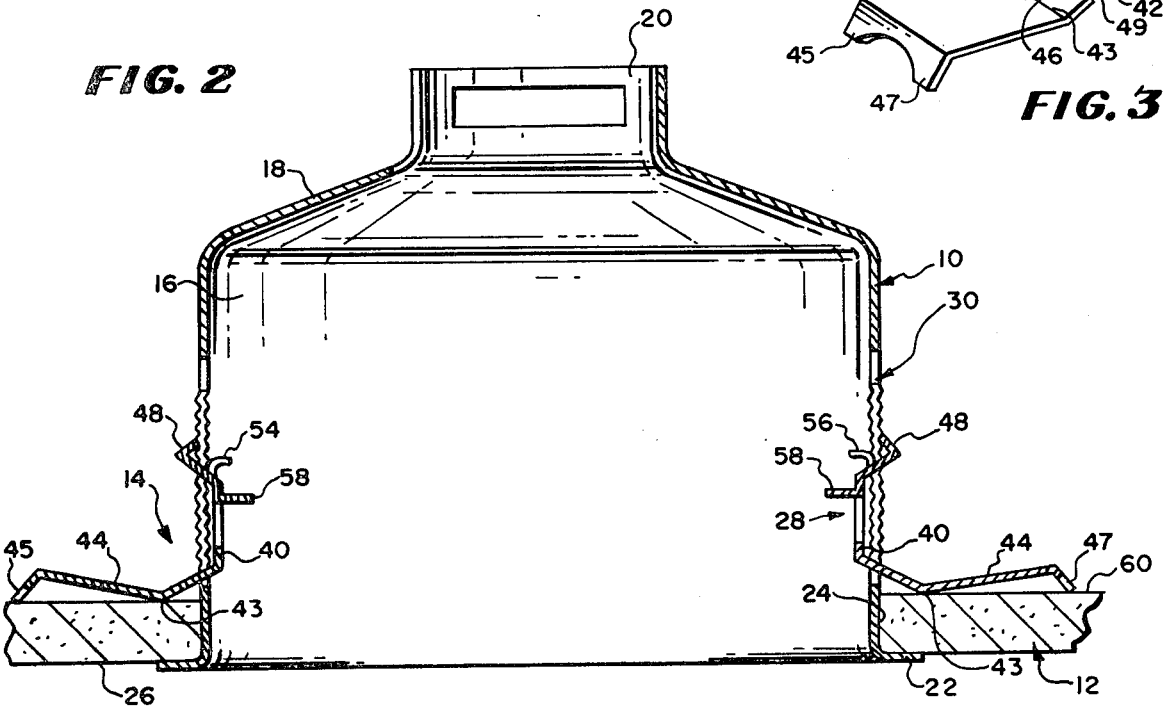

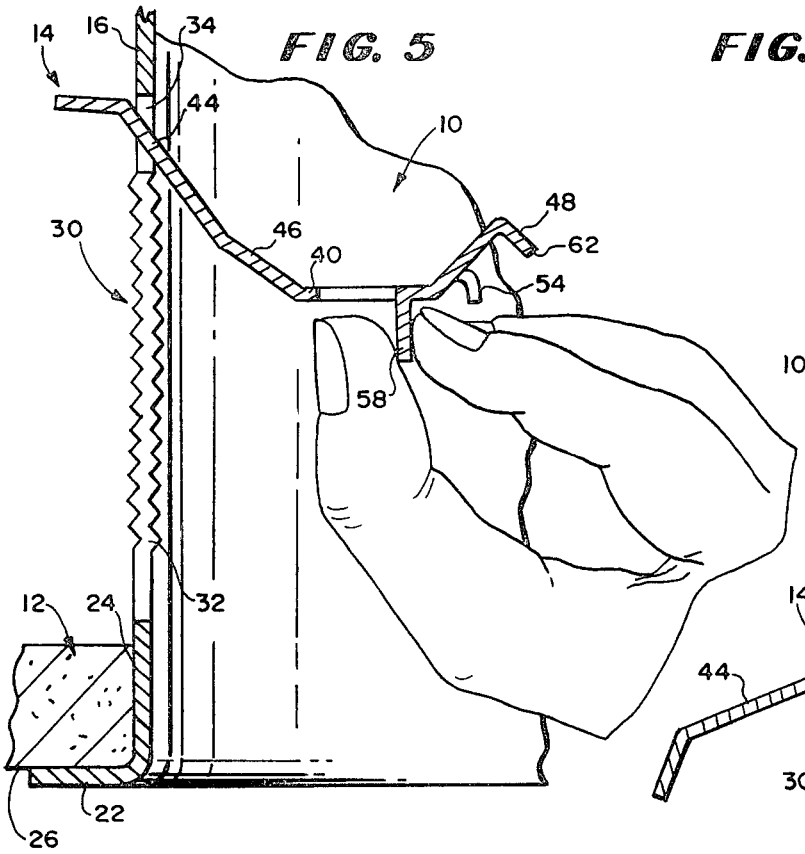
FIG. 5
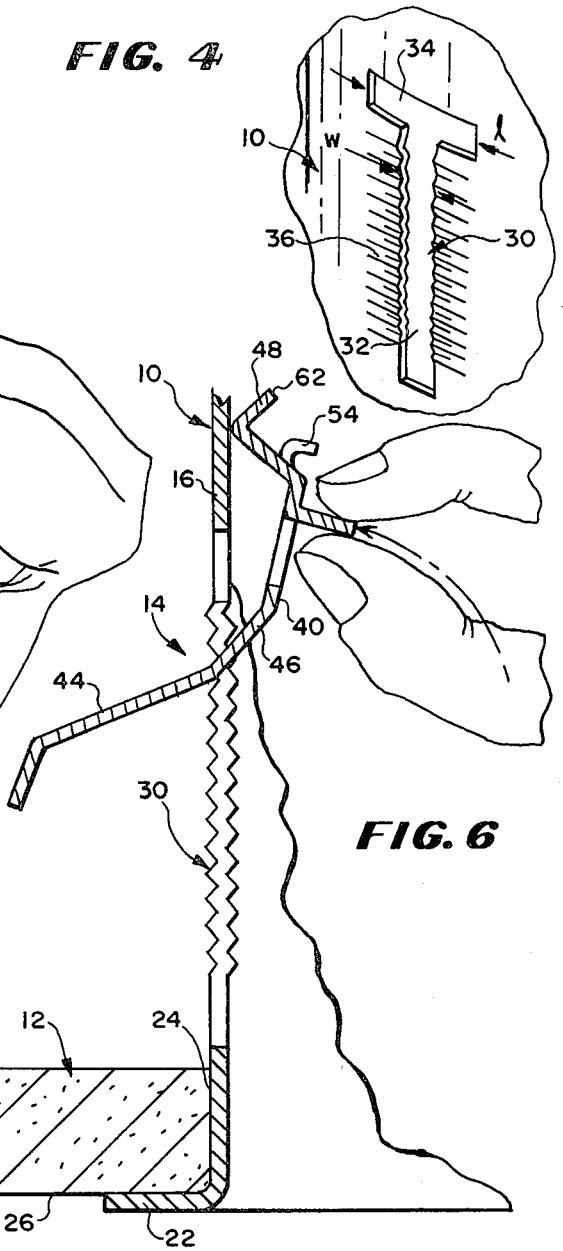
FIG. 4
FIG. 6
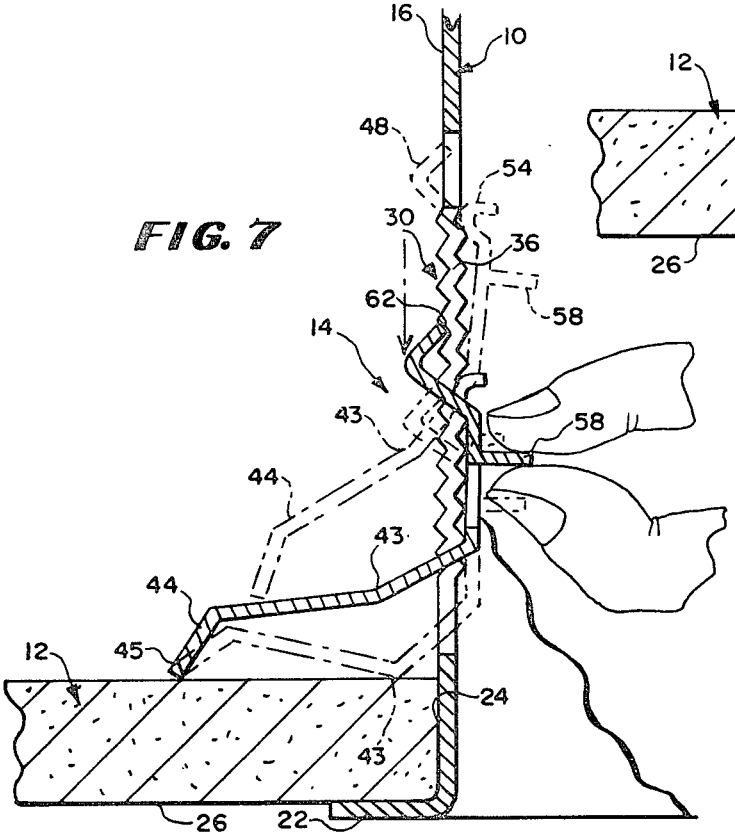
FIG. 7

MOUNTING ARRANGEMENT FOR RECESSED LIGHT FIXTURE HOUSING

BACKGROUND OF THE INVENTION

This invention relates generally to an arrangement for the recessed mounting of an enclosed light fixture housing in an aperture in a planar support member, such as, for example, a ceiling or wall and more particularly to such an arrangement which permits the mounting of the light fixture housing in an existing support member.

Various types of arrangements are presently employed for mounting recessed light fixtures in ceilings or the like planar support members. Some of these arrangements include arms disposed along the outside of an enclosed light fixture housing, which, subsequent to insertion of the housing into the aperture defined in the support member, are rotatable outwardly from the housing to engage a member previously positioned behind the support member, to retain the fixture housing therein. Examples of such arrangements are illustrated in U.S. Pat. Nos. 3,018,082 and 3,018,083.

While the last-mentioned arrangements serve to mount an enclosed light fixture housing in recessed fashion in an aperture in a planar support member, these arrangements are relatively complex in design and include a plurality of elements which must be assembled and affixed to the fixture housing. Furthermore, such mounting arrangements conventionally require additional mounting members, positioned behind the support member prior to insertion of the fixture housing thereinto, which mounting members cooperate with the rotatable arms to secure the light fixture housing in place on the support member. It is often difficult if not impossible to affix the last-mentioned mounting members in existing support members, such as a ceiling or wall.

In addition to the arrangements illustrated in the above-mentioned patents, there is also available in the lighting field, a light fixture, sold under the name Hoffmeister-Leuchten, which does not include an enclosed housing, but merely an open, U-shaped lamp socket support frame attached to a flanged trim ring. The socket support frame includes tabular clips which are received in slots formed in support legs thereof and are movable in the slots on ratchet teeth formed on the legs. The tabular clips are provided for engagement of the inner surface of the support member to secure the light fixture in a mounted position thereon. The tabular clips are insertable into the slots only from the outer surface of the legs of the U-shaped support frame by reaching into the aperture in which the socket support frame is received and around the legs to maneuver the clips into the slots.

While this arrangement is simpler than the others described, employing fewer parts, etc., it is not suitable for use with a fully enclosed light fixture housing mountable in recessed fashion in an aperture in a planar support member, as it would not be possible to insert the tabular clips into the slotted legs of the socket support frame in such case. Furthermore, use of an open light socket frame structure in a ceiling or similar support member, could be unsafe.

SUMMARY OF THE INVENTION

Accordingly, it is the primary object of the present invention to provide a new and improved arrangement for the recessed mounting of an enclosed light fixture housing in a planar support member, such as, for example, a ceiling or wall, which includes a minimum of components, but yet is effective and simple to use.

It is another object of the present invention to provide a mounting arrangement of the above-mentioned type, wherein the components thereof can be assembled from within the enclosed fixture housing subsequent to the insertion thereof into an aperture defined in the support member.

It is still another object of the present invention to provide an arrangement for the recessed mounting of an enclosed light fixture housing which can be employed with an existing ceiling or similar planar support member.

Briefly, an arrangement according to the invention for the recessed mounting of an enclosed light fixture housing in an aperture defined in a planar support member, includes an enclosed housing having an open end with a flange defined about the periphery thereof. At least one elongated, T-shaped slotted aperture is formed in the side wall of the housing with the longer leg of the T extending generally perpendicular to the plane of the support member. Ratchet teeth are formed along the side wall at opposite edges of the longer leg of the slotted aperture. When received in the aperture defined in the support member, the flange formed about the periphery of the open end of the housing engages the outer surface of the support member. The arrangement further includes a mounting clip receivable from the interior of the housing in the elongated T-shaped slotted aperture defined in the housing wall. The clip is movable in the aperture, and includes a first tab for engaging the inner surface of the support member and a second tab for engaging the ratchet teeth. The engagement of the second tab and ratchet teeth locks the first tab into engagement with the support member to secure the housing thereon. An operating tab extends from the clip into the interior of the light fixture housing for manual manipulation, thereby enabling one to slide the clip in the slotted aperture for release of the fixture housing from its mounted position.

IN THE DRAWINGS

FIG. 1 is a perspective view of an enclosed light fixture housing mounted in recessed fashion on a planar support member such as a ceiling or the like, by means of a mounting arrangement according to the invention;

FIG. 2 is a side view of the enclosed light fixture housing and support member of FIG. 1 taken along the line 2—2 thereof;

FIG. 3 is an enlarged, perspective view of a mounting clip employed in the mounting arrangement of FIG. 1, according to the invention;

FIG. 4 is a fragmentary, perspective view of the interior of the side wall of the enclosed light fixture housing, illustrating the T-shaped slotted aperture defined therein for receiving a mounting clip of FIG. 3; and FIGS. 5–7 are enlarged, fragmentary side sectional views of the enclosed light fixture housing of FIG. 1 illustrating the manual insertion of the mounting clip into position in the slotted aperture defined in the side wall of the fixture housing for securing the housing in a mounted position in recessed fashion on the planar support member according to the invention.

DETAILED DESCRIPTION OF THE DRAWINGS

Referring now to the drawings in greater detail wherein like numerals have been employed throughout the various views to designate similar components, an enclosed light fixture housing, designated generally by the numeral 10, is illustrated in FIG. 1, mounted in recessed fashion on planar support member 12, shown in the drawings to be a ceiling, by means of the mounting arrangement, designated 14, according to the invention.

The enclosed light fixture housing 10 is shown as being cylindrical in shape, but may take other shapes and still fall within the scope of the present invention. In the embodiment shown in the drawings, the cylindrical side wall 16 is joined by top wall 18, which itself defines an opening 20 into which a lamp socket (not shown) is received to close off the top of the housing. Along the lower perimeter of the cylindrical side wall 16, there is provided an outwardly extending flange 22.

The housing is received in an aperture 24 defined in the support member 12. Aperture 24 is dimensioned similarly to the cylindrical side wall 16 of the light fixture housing as shown. Upon receipt in the planar support member 12, the flange 22 engages outer surface 26 of the member 12. Mounting arrangement 14 is employed to retain the housing in aperture 24 defined in the support member as illustrated in FIGS. 1 and 2 without additional support.

The mounting arrangement 14 includes a mounting clip designated generally by the numeral 28 which cooperates with specially shaped slotted aperture 30 defined in the side wall 16 of the light fixture housing. In practice, mounting clips located on opposite sides of the housing are employed for securing the housing on the planar support member. Since the mounting arrangements are identical, only one will be described herein.

In a preferred embodiment of the mounting arrangement illustrated in the drawings, slotted aperture 30 defined in the housing side wall is T-shaped (FIG. 4), with the longer leg 32 of the T extending perpendicular to the flange 22 of the housing and perpendicular to the plane of the support member 12 when the housing is in place thereon. The shorter leg 34 of slotted aperture 30 extends parallel to the plane of the support member. Ratchet-like teeth 36 are formed on the housing side wall along opposite vertical edges of the longer leg 32 of the slotted aperture.

Mounting clip 28 is formed of spring steel or other similar resilient material. The clip comprises a central portion 40 from which a first tab 44 extends at end 42. The tab 44 is joined to the central portion 40 by a first neck portion 46 having a width slightly smaller than the width "W" (FIG. 4) of the longer leg 32 of the T-shaped slotted aperture 30. Tab 44 extends outwardly from central portion 40 at a predetermined angle with respect thereto and includes feet 45, 47 at the free end thereof. The last-mentioned feet are used to engage the interior surface 60 of the planar support member 12 upon mounting the housing thereon. The tab 44 is bent along line 43, spaced from the feet 45, 47. Shoulders 49, 51, are formed on tab 44 adjacent neck portion 46.

A second tab 48 is joined at the opposite end 50 of central portion 40 of the clip by a second elongated neck portion 52, the width of the latter also being slightly smaller than the width "W" of the longer leg 32 of the T-shaped slotted aperture 30. Second tab 48 also extends outwardly from central portion 40 at a predetermined angle with respect thereto, in substantially the same direction with respect to central portion 40 as tab portion 44. The widths of the first and second tabs 44, 48, respectively, are slightly smaller than the dimension "L" of the shorter leg 34 of the T-shaped slotted aperture 30 (FIG. 4) so that the tabs 44, 48 can be passed therethrough. A pair of cams 54, 56, extends from end 50 of the central portion 40 of the clip in the same direction as tabs 44, 48 and an operating tab 58 extends from central portion 40 in a direction opposite from cams 54, 56.

The mounting clip is received in slotted aperture 30 from the interior of housing 10 subsequent to the insertion of the light fixture housing into aperture 24 defined in the support member 12. The clip is inserted through aperture 30 as illustrated in FIGS. 5–7 of the drawings.

Turning to the last-mentioned FIGS. 5–7, it can be seen that to insert the clip for the purpose of mounting the housing 10 on the planar support member 12 in a recessed fashion, one grasps the operating tab 58 and places the clip into the interior of housing 10. Thereafter tab 44 is inserted through leg 34 of the aperture 30 until neck portion 46 is aligned with leg 32 of the aperture. At this time, the clip is moved toward the support member 12 so that the side wall 16 of the fixture housing in positioned between central portion 40 and tab 44. The clip is moved further until tab 48 is aligned with the shorter leg 34 of aperture 30. At that time, clip 28 is tipped to pass tab 48 through leg 32 of aperture 30. Clip 28 is then moved toward support member 12 so that cams 54, 56 engage ratchet teeth 36 formed along the interior surface of the side wall 16 of the housing and side wall 16 is received between tab 48 and central portion 40.

In this position, edge 62 of tab 48 engages ratchet teeth 36 on the exterior surface of side wall 16 of the light fixture housing. The clip 28 is lowered until feet 45, 47 of the tap portion 44 engage surface 60 of the planar support member 12 (FIG. 7). Movement of the clip still further toward surface 60 causes the clip to bend until tab 44 engages surface 60 along bend edge 43 thereof, as shown in FIGS. 2 and 7 of the drawings, locking the clip into engagement with support member 12. The resiliency of the clip provides a force sufficient to lock edge 62 of tab 48 into engagement with the ratchet teeth 36 formed along the exterior surface of wall 16 of the housing 10.

If it should become necessary to remove the light fixture housing from its mounted position, operating tab 58 is grasped and moved to disengage edge 62 of tab 48 from the ratchet teeth. Thereafter the clip can be moved in slotted aperture 30 so that tab 44 is released from engagement with surface 60 of support member 12. The clip is slid along ratchet teeth 36 away from the support member 12 and removed through leg 34 of slotted aperture 30.

The mounting arrangement 14 according to the invention is especially well suited for mounting an enclosed light fixture housing of the type shown in existing ceilings where it is virtually impossible to work behind the ceiling support member. With the arrangement 14, all that is required is to form an aperture 24 in the support member through which the light fixture housing is inserted. Electrical wiring is then provided for connection to a lamp socket received in the opening 20 at the top of the housing. Thereafter the mounting of the light fixture housing in recessed fashion on the support member is accomplished quickly and easily as described heretofore. The mounting arrangement according to the invention is versatile, efficient, simple in construction and relatively low cost.

While a particular embodiment of the invention has been shown and described, it should be understood that the invention is not limited thereto since many modifications may be made. It is therefore contemplated to cover by the present application any and all such modifications as fall within the true spirit and scope of the appended claims.

I claim:

1. An arrangement for mounting an enclosed light fixture housing having an open end with a flange formed about the periphery thereof, on a planar support member having first and second surfaces in an aperture therein dimensioned similarly to the dimension of said housing, said housing being receivable in said aperture with the flange engaging said first surface of the support member, said arrangement including in combination:

a side wall of said housing defining a slotted aperture, locking means provided on said side wall adjacent said slotted aperture and mounting clip means receivable in said slotted aperture from the interior of said housing, whereby said clip means is captured in said slot for sliding movement therein toward and away from said support member, said mounting clip means including a first tab for engaging the second surface of said support member upon moving said mounting clip means toward said support surface and a second locking tab for engaging said locking means thereby to maintain said first tab in engagement with said support surface, whereby said light fixture housing is releasably secured on said support member.

2. A mounting arrangement as claimed in claim 1 wherein said slotted aperture is T-shaped with the longer leg of the T extending from the shorter leg thereof toward the open end of said housing and wherein said locking means includes ratchet teeth formed on said housing side wall adjacent the longer leg of said slotted aperture for engagement by said second locking tab of said mounting clip means.

3. A mounting arrangement as claimed in claim 2 wherein said mounting clip means includes a body portion to which said first and second tabs are joined at predetermined angles with respect thereto, the width of each of said tabs being greater than the width of the longer leg of said slotted aperture, but less than the length of the shorter leg of said slotted aperture, whereby said tabs may be passed through said shorter leg of said slotted aperture only, whereby said mounting clip means is mountable in said housing side wall in said slotted aperture for movement along the longer leg thereof toward and away from said support surface, for releasably securing said housing in said support surface.

4. An arrangement for mounting an enclosed light fixture housing having an open end with a flange formed about the periphery thereof, on a planar support member having first and second surfaces, in an aperture dimensioned similarily to the dimension of said housing defined in said support member, said housing being receivable in said aperture with said flange engaging the first surface of said support member, said arrangement including in combination: p1 a side wall of said housing defining a T-shaped slotted aperture, the longer leg of which extends from the shorter leg toward the flange of said housing, ratchet teeth means provided on said side wall at least along one edge of said longer leg of said slotted aperture and a mounting clip including a central body portion, a first tab of a width slightly less than the length of said shorter leg of said slotted aperture but greater than the width of said longer leg, joined to said body portion at a first end and extending outwardly therefrom in a first direction and a second, locking tab of a width slightly less than the length of said shorter leg of said slotted aperture but greater than the width of said longer leg of said aperture, extending from the opposite end of said body portion in said first direction, first and second neck portions joining said tabs to opposite ends of said central body portion, respectively, the width of each said neck portion being less than the width of the longer leg of said T-shaped slotted aperture, said mounting clip being receivable in said T-shaped aperture from the interior of said housing so that said first and second tabs are positioned along the exterior of the side wall of the fixture housing and the body portion is positioned along the interior thereof with said neck portions extending through the longer leg of said slotted aperture, whereby said clip is captured in said slotted aperture and is movable therein toward and away from said second surface of said support member, so that upon movement of said clip toward said support member, said first tab engages the second surface of said support member and said locking tab engages said ratchet teeth, thereby to releasably secure said housing in a mounted position on said support member.

5. A mounting arrangement as claimed in claim 4 wherein said mounting clip further includes cam means, said cam means engaging said ratchet teeth to permit said clip to slide relatively smoothly along said housing side wall into and out of locking engagement with said support member.

6. A mounting arrangement as claimed in claim 4 wherein said mounting clip further includes an operating tab extending from said central body portion and into the interior of said fixture housing, for manually manipulating said clip in said slotted aperture.

7. The method of mounting an enclosed light fixture housing in an aperture defined in a generally planar support member having first and second surfaces, said housing having an open end with a flange portion extending about the periphery thereof and a side wall defining at least one T-shaped slot therein, the longer leg of the slot extending from the shorter leg toward the open end of said housing and ratchet teeth formed along the side wall of said housing at the edge of the longer leg of said slot and a mounting clip having a first tab of a width greater than that of the longer leg of said T-shaped slot, a body portion also of a width greater than the width of the longer leg of the T-shaped slot and a second tab of a width greater than that of the longer leg of the T-shaped slot, said body portion and said first and second tabs being joined by first and second neck portions, respectively, each being of a width less than that of the width of said longer leg of said slot, said method comprising the steps of inserting said housing into the aperture defined in said support member with the flange portion thereof engaging said first surface of said support member, inserting said clip member into said T-shaped slot from the interior of said housing so that said first and second tabs are located on the exterior surface of said side wall of said housing and the body portion is located on the interior surface of said side wall of said housing with said first and second neck portions passing through the longer leg of the T-shaped slot and the second tab engaging said ratchet teeth, and moving said clip along said housing side wall in the longer leg of said T-shaped slot toward said second surface of said support member until said first tab engages said surface, the second tab locking said clip member in position, thereby securing said housing in a mounted condition on said support member.

* * * * *